United States Patent [19]

Dewey

[11] 4,189,278

[45] Feb. 19, 1980

[54] BOOM PROP

[75] Inventor: Ronald A. Dewey, Buffalo Grove, Ill.

[73] Assignee: International Harvester Company, Chicago, Ill.

[21] Appl. No.: 939,310

[22] Filed: Sep. 5, 1978

Related U.S. Application Data

[63] Continuation of Ser. No. 791,903, Apr. 28, 1977, abandoned.

[51] Int. Cl.[2] ..... E02F 3/36

[52] U.S. Cl. ..... 414/713; 187/8.49; 212/145; 298/17 B

[58] Field of Search ..... 214/140, 776; 212/39 R, 212/145; 187/8.49; 298/17 B; 414/697, 713

[56] References Cited

U.S. PATENT DOCUMENTS

| | | | |
|---|---|---|---|
| 3,918,601 | 11/1975 | Zimmerman | 214/776 |
| 4,039,093 | 8/1977 | Schmitz, Jr. et al. | 214/776 |

FOREIGN PATENT DOCUMENTS

| | | | |
|---|---|---|---|
| 1138643 | 10/1962 | Fed. Rep. of Germany | 298/17 B |

*Primary Examiner*—Joseph F. Peters, Jr.
*Assistant Examiner*—Ross Weaver
*Attorney, Agent, or Firm*—Ronald C. Kamp; F. David AuBuchon

[57] ABSTRACT

A boom prop for supporting in an elevated position a pair of boom arms interconnected by a cross tube, including a link pivotally mounted on a vehicle with a saddle member secured to its free end capable of engaging and supporting the cross tube. An adjustable stop means positions the saddle member in the path of the cross tube so that the link and saddle are cammed out of the path of the cross tube as the boom arms are raised and gravity returns the saddle to the position determined by the stop means when the boom arms are subsequently lowered.

1 Claim, 3 Drawing Figures

BOOM PROP

This is a continuation of application Ser. No. 791,903 filed Apr. 28, 1977, now abandoned.

BACKGROUND AND SUMMARY OF THE INVENTION

Supports or props for holding the boom arm or arms on a material handling vehicle in an elevated position have been in use for some time. The most common means utilized on these material handling vehicles which rely upon the extension of hydraulic cylinder or cylinders to raise the boom arms is to simply clamp a piece of angle iron, of proper length to span the distance between the end of the cylinder and the boom, to the extended rod of at least one of the boom cylinders. The angle iron, being in contact with both the rod end of the cylinder and the boom arm, will physically prevent the collapse of the boom cylinders, even if the hydraulic fluid is exhausted from the head end of the boom cylinders. However, such a means requires the installation and removal of the clamps to be performed while the boom arms are in an elevated position, which is awkward at best and with larger loaders require some auxially support, such as the ladder, for the workman installing or removing the angle iron. Such an arrangement is also undesirable because the elements of the prop or support are separable from, and are not intrinsically carried by the vehicle. Storage of the clamps and angle iron piece then becomes a nuisance.

Another type of known boom prop or support, such as that shown in U.S. Pat. No. 3,918,601 issued November 1975 to R. F. Zimmerman, supports the boom arms by locking the implement linkage. Such supports however, have application only to those types of vehicles which utilize a four-bar linkage or some modification thereof, to actuate the implement. Still other types of boom props have required the pinning of a structural member between the vehicle and the boom. Alignment of the holes with such arrangements are necessary and dictate the proper coordination of an operator in the vehicle cab, who is controlling the vertical elevation of the boom, with another workman who must insert a pin when the holes in the prop and the boom arm are aligned.

Another type of boom prop, such as that shown in U.S. Pat. No. 3,995,761 issued Dec. 7, 1976, function by physically blocking a linkage to which the boom arms are pivoted. This arrangement overcomes most of the aforementioned disadvantages, but is not applicable to the conventional commercial loader in which the boom arms are pivoted directly to the vehicle.

It is therefore an object of this invention to provide a boom prop for a conventional loader which is simple, which may be rendered operative or stored by one individual, and which positively limits downward movement of elevated boom arms but does not restrict the upward movement of the boom arms above the limit of the downward movement.

It is also an object of this invention to provide a boom prop which may be adapted to conventional loaders regardless of the type of linkage provided to actuate the implement, which is capable of compensating for tolerances normally encountered in manufacture and which is convenient to store when not in use. These and other objects and many of the intended advantages of this invention will become more readily apparent from a perusal of the following detailed description and the accompanying drawings, wherein.

DESCRIPTION OF A PREFERRED EMBODIMENT

Figure 1:
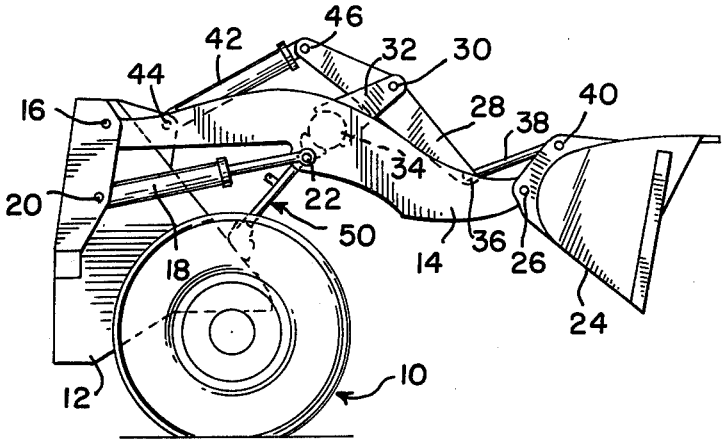
FIG. 1 is a side elevational view of the front portion of a vehicle with a boom prop according to the present invention in place to support the boom arms.

Referring now to FIG. 1, there is shown the front portion of a loader vehicle, indicated generally at 10, having a frame 12. A pair of boom arms, one of which is shown at 14, is pivotally mounted on the vehicle by means of pivot pins 16. A hydraulic ram 18 has its head end pivotally attached to the vehicle by pivot pin 20 and its rod eye secured to the boom arm 14 by pivot pin 22. An implement, such as bucket 24 is pivotally carried on the end of the boom arms 14 by pivot pins 26. As will be apparent, extension of the hydraulic ram 18 causes the boom arms 14 to rotate counterclockwise about the axis of pin 16 raising the bucket 24, and similarly, contraction of the rams 18 causes the bucket to lower.

A self-leveling linkage of the four bar type, commonly referred to as a Z-bar linkage, is attached between the bucket 24 and the vehicle 10. This linkage comprises a lever 28 which is pivotally supported intermediate its ends by pin 30 on a mast 32 rigidly secured to, and positioned intermediate the length of, a cross tube 34, which cross tube spans the distance between, and is affixed to, the two boom arms 14. A link 38 is pivotally attached to one end of the lever 28 by pin 36 and to the rearward side of the bucket 24 by pin 40. A hydraulic ram 42 is pivotally secured to the vehicle 10 by means of pin 44 and to the other end of the lever 28 by means of pin 46. Extension of the ram 42 causes the bucket to roll back and contraction of ram 42 moves the bucket towards its dump position, as shown in FIG. 1.

Figure 3:
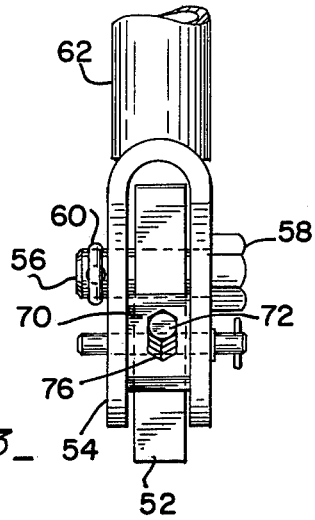
FIG. 3 is a view taken on line 3—3 of FIG. 2.
Figure 2:
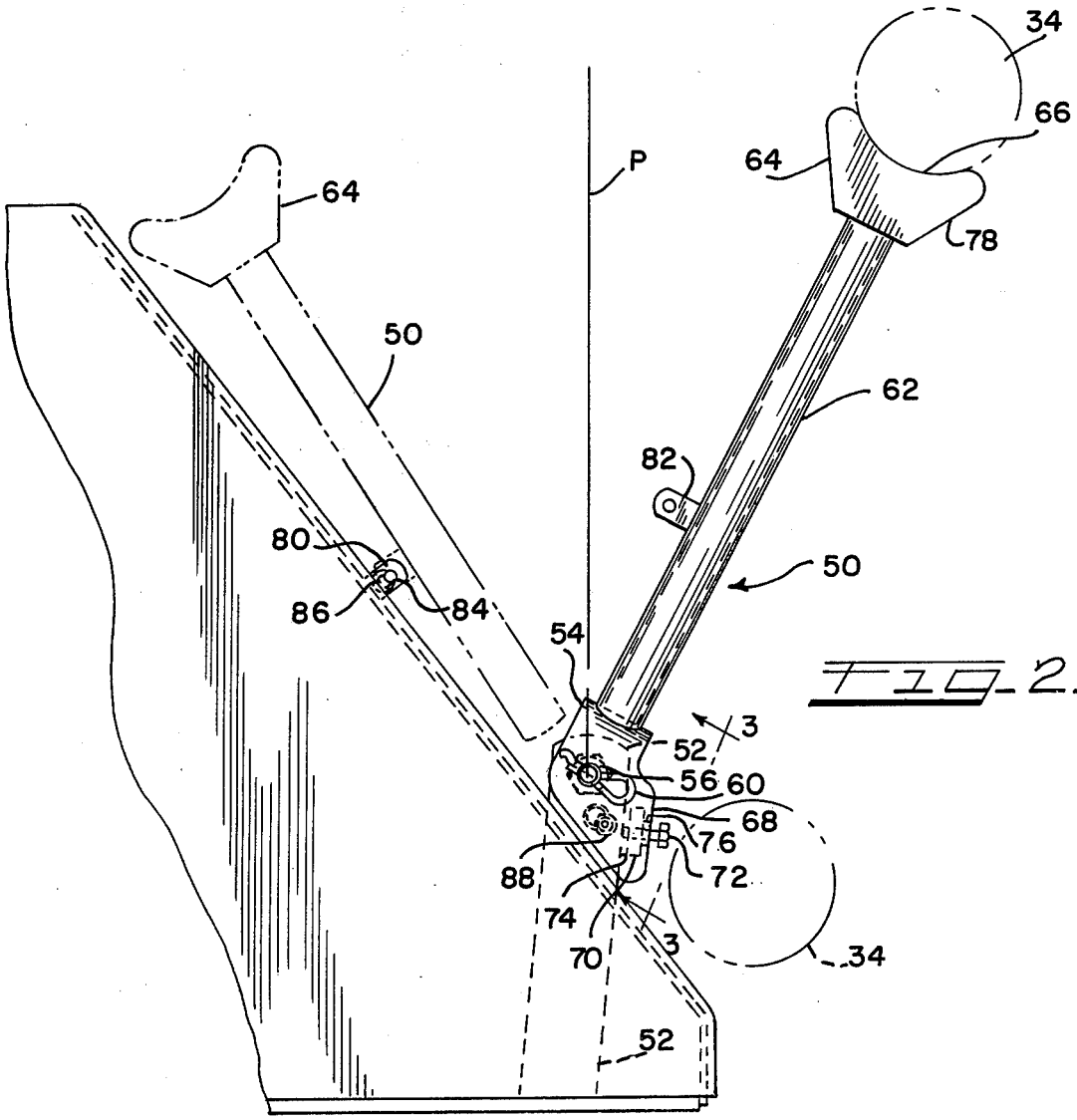
FIG. 2 is a detailed view of the boom prop in FIG. 1.

The boom prop, indicated generally at 50, is shown in greater detail at FIGS. 2 and 3. A base member 52 is secured to vehicle frame 12; a convenient method of attachment being conventional welding. A generally U-shaped clevis member 54 is designed to straddle the base member 52. A pin 56 having an enlarged head 58 extends through aligned holes in the clevis member 54 and the base member 52, and defines a pivot axis for the clevis on the base member. A keeper 60 is inserted in an opening in the pin 56 to retain the pin in place. Tubular link member 62 has one of its ends secured to the clevis 54 and the other end to a saddle member 64. An arcuate surface 66 is provided in the saddle member 64 to accept the cross tube 34. It will be apparent, with the cross tube supported in the arcuate surface 66 of the saddle 64, that the boom arms 14 will be prevented from lowering, even if hydraulic pressure is exhausted from the head end of the hydraulic ram 18.

Because of the normal tolerances encountered in manufacturing, it is nearly impossible to assure that the cross tube 34 will properly contact the arcuate surface 66. In order to compensate for such tolerances, each leg of the clevis 54 is provided with protruding portion 68, and a cross member 70 is secured between these portions. The reason for the protrusion is to provide clearance between the base member 52 and the cross member 70, as the prop 50 is moved to its stored position, as shown in dotted lines in FIG. 2. A bolt 72 engages a threaded opening in the cross member 70 and extends into contact with a stop surface 74 on the base member 52. By turning the bolt 72 inward or outward, compensation for manufacturing tolerances on each individual vehicle can be made to insure that the prop 50, under the influence of gravity, will always be positioned with the arcuate surface 66 of the saddle member 64 in proper registry with the cross tube 34. A lock nut 76 is provided on the bolt 72 to insure that the proper adjustment of the bolt 72 will not be unintentionally altered.

It should be noted that the saddle member 64 is in the path of the cross tube 34 defined by the pivoting of the boom arms 14 about pin 16, as it must be to insure the aforementioned registry of cross tube with the saddle. If the boom arms 14 are in lowered position with the cross tube below the saddle, subsequent raising of the boom arms will bring the cross tube 34 into contact with the inclined surface 78 of the saddle 64 causing the prop 50 to rotate counterclockwise, as viewed in FIG. 2, the cross tube 34 functioning as a cam and the inclined surface 78 functioning as a cam follower. In order that gravity will return the prop 50 to the solid line position shown in FIG. 2, after the cross tube has passed the saddle, it is necessary that the center of gravity of the prop 50 always be forward of a vertical plane P passing through the axis of the pin 56. In other words, the rearward displacement of the center of gravity of the prop 50, as the prop is cammed out of the way to permit the cross tube 34 to pass the saddle 64, must not cross the aforementioned vertical plane.

In the stored position, as shown in dotted lines in FIG. 2, the prop 50 is rendered inoperative and yet is always readily available for use. To retain the prop 50 in its stored position, an apertured tab 80 is attached to the vehicle and a similar tab 82 is affixed to the tubular link member 62. The tab 80 is positioned on the vehicle so that the apertures of the tabs align when the prop is moved to its stored position. A ball detent pin 84 with a pull ring 86 is inserted in the aligned apertures of the tabs 80 and 82 to releasably secure the prop in its stored position. The pin 84 is also used to releasably secure the prop 50 in its operative position. Each arm of the clevis 54 is provided with an aperture which are substantially the same diameter as the apertures and tabs 80 and 82. The base member 52 also is provided with an opening 88. However, the opening 88 must be larger than the apertures in the clevis arms because of the adjustment provided by the bolt 72. The diameter of the opening 88 must be sufficiently enlarged to permit the detent pin 84 to be inserted through the apertures in the clevis and the opening 88 regardless of the adjustment of the bolt 72 relative to the stop surface 74.

Starting with the prop 50 in its stored position, the prop is rendered operative as follows. The operator lowers the boom arms 14 so that the bucket 24 is resting on the ground. He then dismounts from the vehicle cab to remove the detent pin 84 from the tabs 80 and 82 and rotate the prop 50 clockwise as viewed in FIG. 2, until the stop surface 74 is contacted by the end of the bolt 72. The operator then re-enters the cab to slowly raise the boom arms 14. As the cross tube 34 contacts inclined surface 78 the boom prop 50 is cammed out of the path of prop. Once the cross tube has passed the saddle 64, gravity will return the prop 50 to the position determined by the bolt 72 contacting the stop surface 74. The operator then lowers the boom arms 14 until the cross tube 34 rests in the arcuate surface 66 of the saddle 64. The operator then dismounts from the cab to insert the detent pin 84 in the apertures of the clevis 54 and the base member 52 to prevent inadvertent dislodging of the prop 50 from the cross tube 34. Throughout this procedure the operator avoids exposure to an unsupported boom arm - implement structure.

Return of the prop 50 to its stored position is also simple and secure. The detent pin 84 is removed from the clevis 54. The operator then enters the cab to raise the boom arms 14 a sufficient distance to clear the saddle 64. The operator can leave the cab to rotate the prop 50 to its stored position. However, a more convenient way to so rotate the prop 50 with the boom arms in an elevated position is by means of a tension member secured to the prop 50, such as a light rope tied to the tab 82. This expedient permits the operator to remain in the vehicle cab after the detent pin 84 is removed from the clevis 54 to manipulate valve controls to first raise the boom arms to clear the saddle, pull on the rope to rotate the prop to its stored position and then manipulate the valve controls to lower the boom arms to rest the bucket on the ground. With the bucket so orientated it is a simple matter to dismount from the cab and insert the detent pin 84 in the tab 80 and 82.

It is, of course, not necessary for practice of this invention for the cross tube to also function as a support for the implement linkage. The cross tube may be simply a reinforcement member between the boom arms. For that matter, on vehicles which have no cross tube extending between the boom arms, a simple cam member, which may for example take the form of a short cantilever tube secured to the inside surface of one of the boom arms, would function as well.

The foregoing description presents the currently preferred embodiment of this invention. Details of construction have been shown and described for purpose of illustration rather than limitation. Modifications and alterations of the invention may occur to those skilled in the art that will come within the scope and spirit of the following claims.

What is claimed is:

1. In a material handling vehicle having a pair of boom arms pivotally mounted at one of their ends to the vehicle, a bucket pivotally mounted on the other end of said arms, a cross tube extending between and connected to the boom arms at a location intermediate the ends of the boom arms, means for pivoting said boom arms to define a path of movement for said cross tube; an improved support for selectively holding the boom arms in an elevated position while permitting normal manipulation of the bucket comprising:

a base member having a stop surface affixed to the vehicle;

a prop including a tubular link member with a clevis affixed to one end and a saddle affixed to the other end;

said clevis straddling said base member and pivotally attached thereto to permit said prop to be pivoted between a stored position adjacent said vehicle and a support position;

said saddle having an outwardly-opening arcuate surface complementary to and engageable with said cross tube, and an inclined surface merging with said arcuate surface to function as a cam follower;

a cross-member having a threaded opening attached to and spanning said clevis;

a threaded stop member engaging said threaded opening and, by contact with said stop surface, limiting movement of said prop toward its support position to permit positioning of said saddle precisely in said path;

a tab on each of said link member and said vehicle having alignable openings when said prop is moved to its stored position;

a retaining pin insertable in said alignable openings to releasably secure said prop in its stored position;

said clevis having pin-receiving openings substantially the same as said alignable openings on said tabs;

said base member having an enlarged opening to permit insertion of said retaining pin through said pin-receiving openings and said enlarged opening, after adjustment of said threaded stop member, to releasably secure said prop in its support position; and said prop, when in its support position, having a center of gravity located so that travel of said cross tube, as said boom arms are raised from their lowered position, will engage said cam surface to move said prop toward its stored position, but will maintain the center of gravity of said prop forward of the vertical plane passing through the pivotal connection of said prop to said base member, whereby said prop will return to its support position.

* * * * *